US008858348B2

(12) United States Patent
Riley et al.

(10) Patent No.: US 8,858,348 B2
(45) Date of Patent: Oct. 14, 2014

(54) ICE-RINK DASHERBOARDS LACKING PROTRUDING SILLS

(75) Inventors: Terence William Riley, Princeton (CA); Sean James Riley, Burlington (CA)

(73) Assignee: 1196501 Ontario Inc., Woodstock, Ontario (CA)

( * ) Notice: Subject to any disclaimer, the term of this patent is extended or adjusted under 35 U.S.C. 154(b) by 285 days.

(21) Appl. No.: 13/255,362

(22) PCT Filed: Mar. 18, 2010

(86) PCT No.: PCT/CA2010/000392

§ 371 (c)(1), (2), (4) Date: Sep. 8, 2011

(87) PCT Pub. No.: WO2010/105353

PCT Pub. Date: Sep. 23, 2010

(65) Prior Publication Data

US 2012/0001139 A1 Jan. 5, 2012

(30) Foreign Application Priority Data

Mar. 18, 2009 (GB) ..... 0904617.8

(51) Int. Cl.

*A63C 19/10* (2006.01)
*E01C 13/08* (2006.01)
*A63C 19/08* (2006.01)

(52) U.S. Cl.

CPC ..... *A63C 19/10* (2013.01); *A63C 2019/085* (2013.01)

USPC ..... 472/92; 472/94

(58) Field of Classification Search

USPC ..... 472/88, 89, 92, 94; 256/1, 24, 25, 73

See application file for complete search history.

(56) References Cited

U.S. PATENT DOCUMENTS

| | | | | |
|---|---|---|---|---|
| 4,271,622 | A | 6/1981 | Tippmann et al. | |
| 4,883,267 | A | 11/1989 | Burley | |
| 4,905,970 | A | 3/1990 | Holmsten et al. | |
| 4,927,134 | A | 5/1990 | Burley | |
| 5,312,109 | A * | 5/1994 | Cagle | 473/446 |
| 6,004,217 | A * | 12/1999 | Johnston et al. | 472/92 |
| 6,095,503 | A | 8/2000 | Burley et al. | |
| 6,226,849 | B1 | 5/2001 | Beck et al. | |
| 6,622,434 | B1 * | 9/2003 | Garrett | 52/6 |
| 6,783,461 | B2 * | 8/2004 | Frazier et al. | 472/92 |
| 7,077,756 | B2 * | 7/2006 | Martin et al. | 472/92 |
| 7,174,851 | B2 | 2/2007 | Bonner et al. | |
| 7,360,932 | B2 | 4/2008 | Uken et al. | |
| 7,427,096 | B2 | 9/2008 | Snider et al. | |
| 7,481,549 | B2 | 1/2009 | Hess | |
| 7,559,536 | B1 * | 7/2009 | Hansen et al. | 256/25 |

* cited by examiner

*Primary Examiner* — Kien Nguyen
(74) *Attorney, Agent, or Firm* — Anthony Asquith Corp.

(57) ABSTRACT

A system to reduce or eliminate the sill of dasher boards on the play area side of a transparent plane is disclosed. The system features spacers and extensions which support the transparent panes in a more inward position. The system can be installed initially or used to retrofit an arena. The system is suitable for straight and curved-corner portions of the boards assembly. The system is suitable for use with panes of tempered glass or of transparent plastic.

15 Claims, 5 Drawing Sheets

ICE-RINK DASHERBOARDS LACKING PROTRUDING SILLS

This invention relates to ice rinks, and particularly to hockey rinks.

BACKGROUND TO THE INVENTION

Hockey-rink dasherboards have to be robust enough to survive being crashed into by players. In hockey-rinks, dasherboards generally are surmounted by glass-shield panes to protect spectators from errant pucks. These panes should have a corresponding robustness, and the manner in which the panes are attached to the dasher boards also should have a corresponding robustness.

The dasher boards are built around a structural framework of metal or wood, which is attached firmly to the (concrete) floor of the rink, around the edges of the playing surface. The framework is faced with panels of wood, or more usually of plastic, and preferably of impact-deadening plastic. The ice-facing surface of the dasherboards is deliberately kept smooth and edge-free, in an attempt to minimise injuries when players crash into the boards.

Typically, the dasherboard structure is e.g thirteen of fifteen centimeters wide, and the glass-shield panes are e.g 12 or 15 mm thick. Traditionally, the glass-panes have been mounted at a roughly halfway-across-the-width location on top of the dasherboards. As a result, traditionally, in hockey rinks, there is a sill, or upwards-facing ledge, some six cm or so wide, at the junction between the dasherboards and the glass-shield panes.

This horizontal sill or ledge runs round the entire rink. It faces upwards, and is at a height, typically, of approximately one meter. Of course, the rink-owners see to it that the upwards-facing sill is covered with impact-deadening materials, but even so, many injuries are caused to players who crash into the boards while falling, whereby all too often it is the player's face or head that strikes the upwards-facing surface of the sill.

An aim of the invention is to reduce the injuries that are attributable to the traditional window-sill.

THE INVENTION IN RELATION TO THE PRIOR ART

It is recognized that the traditional sill between the dasherboards and the glass-shield-panes is dangerous. Also, it is recognized that the sill can be more or less eliminated as an injury-inflicting element.

The manner in which the glass-shield panes are affixed to the top surface of the dasherboard structure is a key factor in considering how, or whether, the sill can be eliminated. During a hockey game, players crash against not only the dasherboards, but also against the glass panes, and the designer of the boards-plus-glass system must see to it, not only that the dasherboards and the glass-shield panes themselves are sturdy enough to withstand these impacts, but the designer must also see to it that the means of attachment of the glass-shield panes to the dasherboards is also sturdy enough, as a coordinating structure, to sustain the impacts, and is also capable of transferring the stresses and strains arising from the impacts into the dasherboard framework upon which the glass pane is mounted.

It is recognized that the glass-shield panes can, as a matter of the physical structure required to meet the sturdiness demands, be mounted atop the dasherboards with the ice-facing surface of the glass-shield pane more or less flush with the ice-facing surface of the dasherboard.

BRIEF DESCRIPTION OF PREFERRED EMBODIMENTS

The technology will now be further described with reference to the accompanying drawings, in which.

Figure 3:
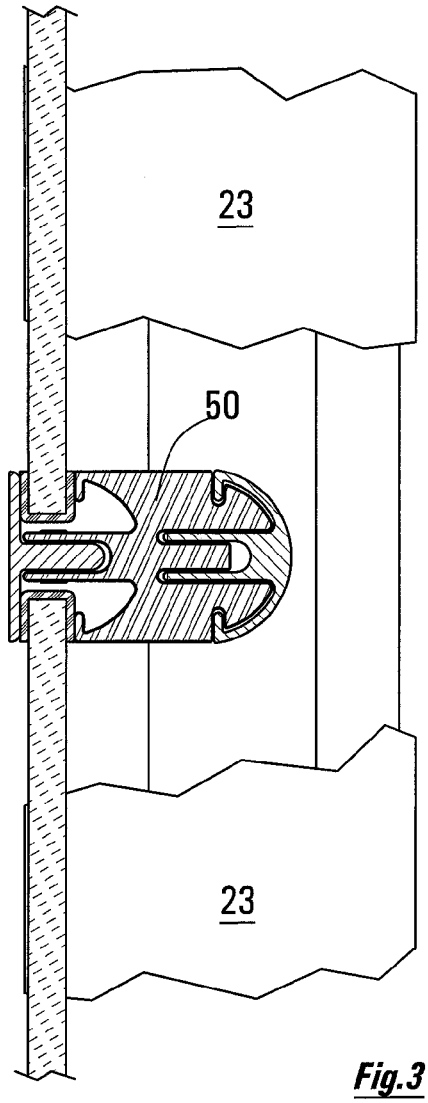
FIG. 3 is a view corresponding to FIG. 1, in which the glass-shield panes have been moved forwards, towards the ice, in accordance with the technology described herein.
Figure 3A:
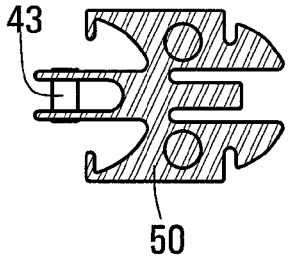

FIG. 3*a* shows the profile of a space-member component of the structure of FIG. 3.

Figure 2:
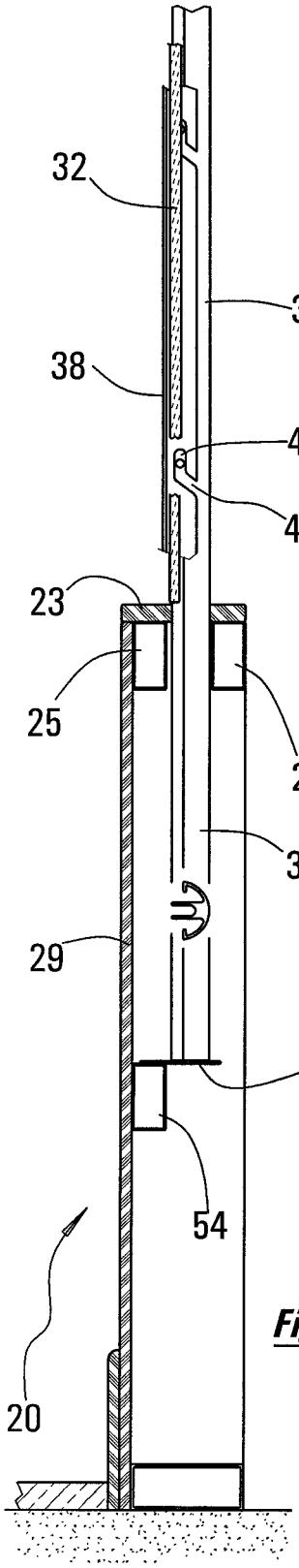
FIG. 2 is a side view of the structure of FIG. 1
Figure 4:
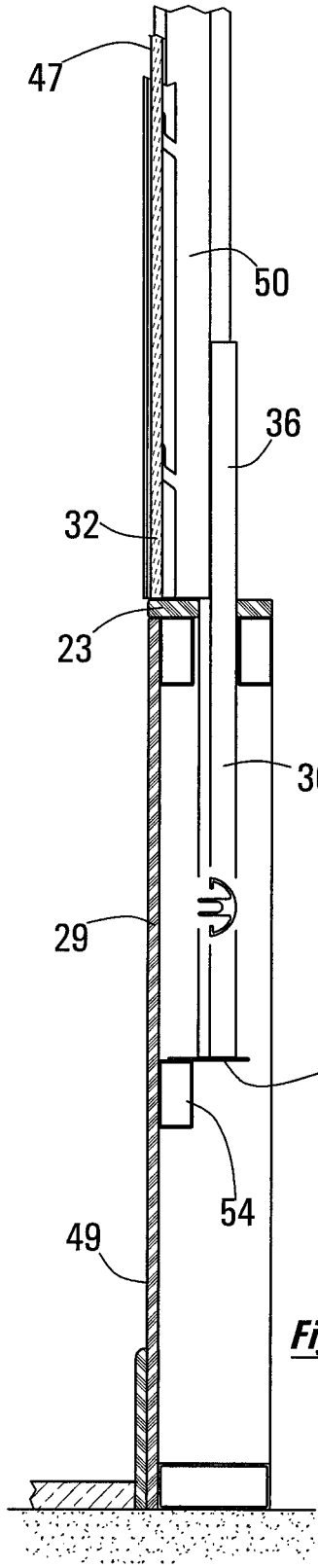

FIG. 4 is a sectioned side-elevation, corresponding to FIG. 3 of the structure of FIG. 2.

Figure 5:
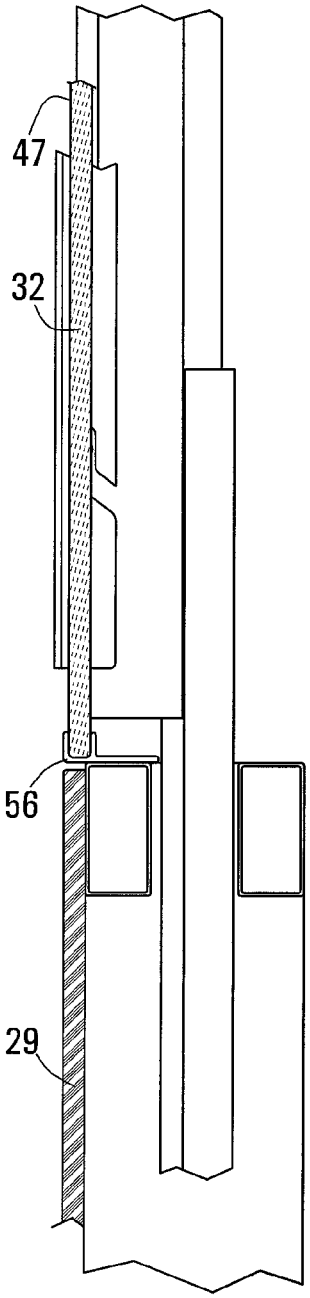

FIG. 5 is a view similar to FIG. 4, of parts of an alternative structure.

Figure 6:
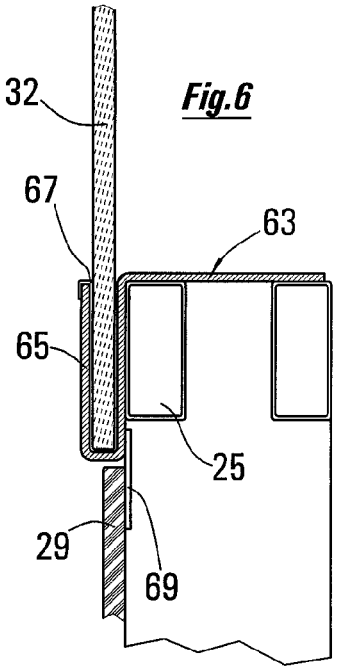

FIG. 6 is a view similar to FIG. 4, of parts of another alternative structure.

Figure 7:
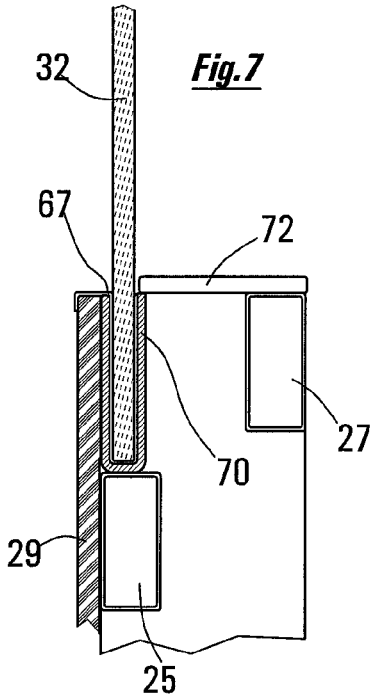

FIG. 7 is a view similar to FIG. 4, of parts of a further alternative structure.

Figure 8:
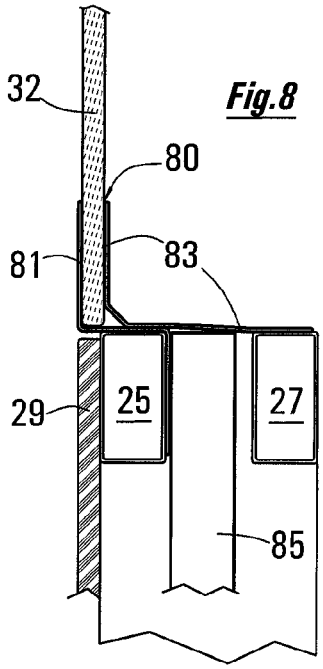

FIG. 8 is a view similar to FIG. 4, of parts of yet a further alternative structure.

Figure 9:
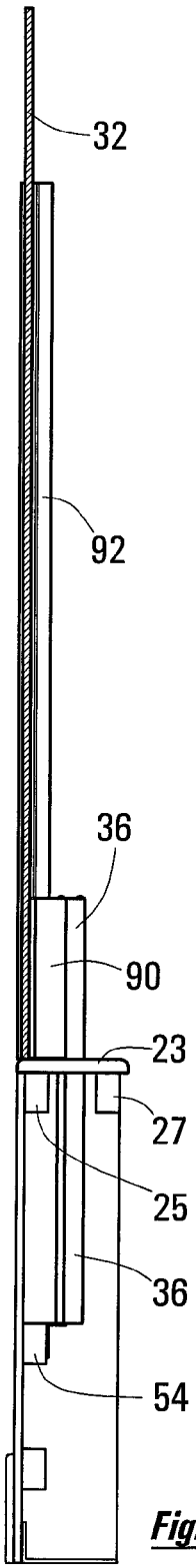

FIG. 9 is a view similar to FIG. 4, of parts of yet another alternative structure.

Figure 10:
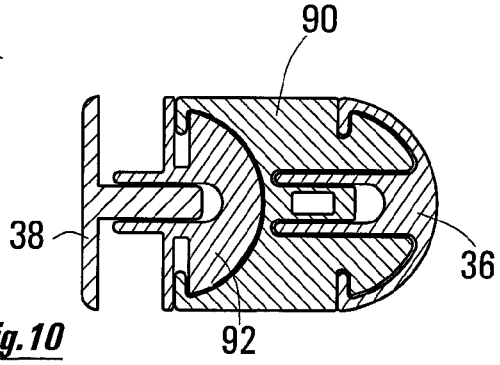

FIG. 10 is a view similar to FIG. 4, of an alternative structure.

Figure 11:
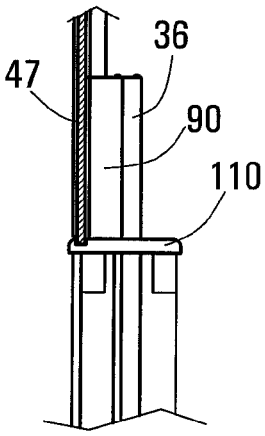

FIG. 11 is a view similar to FIG. 4, of a modification to the structure of FIG. 10.

Figure 12:
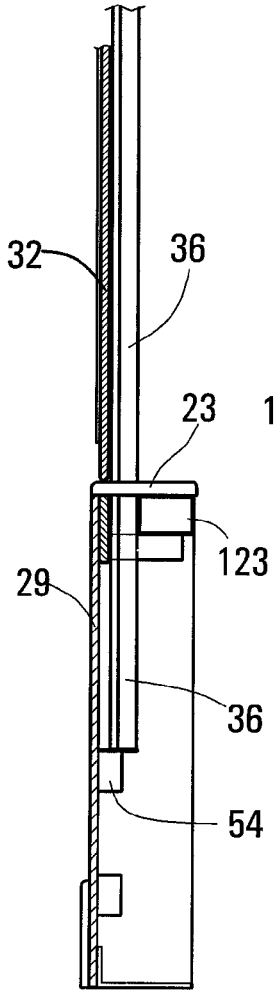

FIG. 12 is a plan view of a section of a dasherboard assembly, having curved panes.

Figure 13:
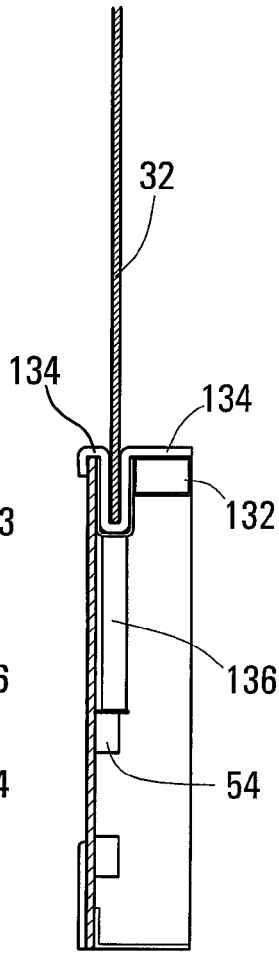

FIG. 13 is a plan view of a section of a dasherboard assembly, having straight panes.

Figure 14:
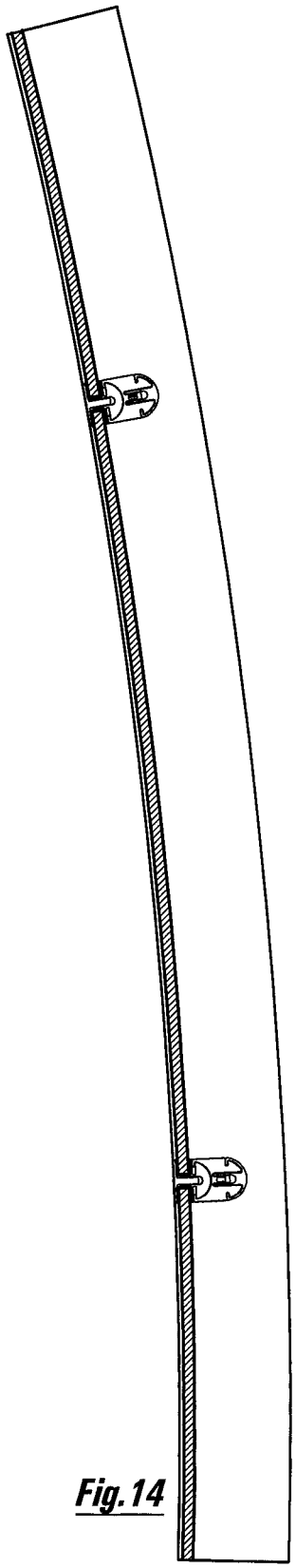

FIG. 14 shows a portion of a curved board unit, in which the panes are curved, to follow the curvature of the dasherboards.

Figure 15A:
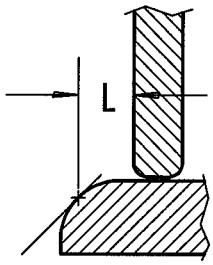
Figure 15:
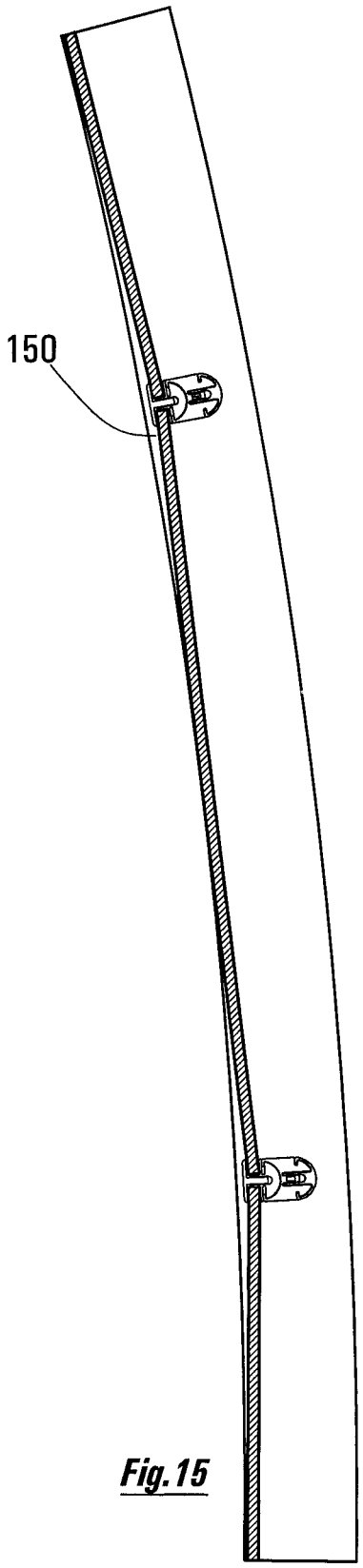

FIG. 15 shows a portion of a similar curved board unit, in which the panes are straight, or flat, and are laid at a small angle relative to each other in order to follow the curvature of the dasherboards.

FIG. 15*a* is a close-up of an upwards-facing surface, or land, and indicates the manner in which the width of the land is measured.

DETAILED DESCRIPTION OF PREFERRED EMBODIMENTS

The scope of the patent protection sought herein is defined by the accompanying claims, and not necessarily by the particular features of specific embodiments.

Figure 1:
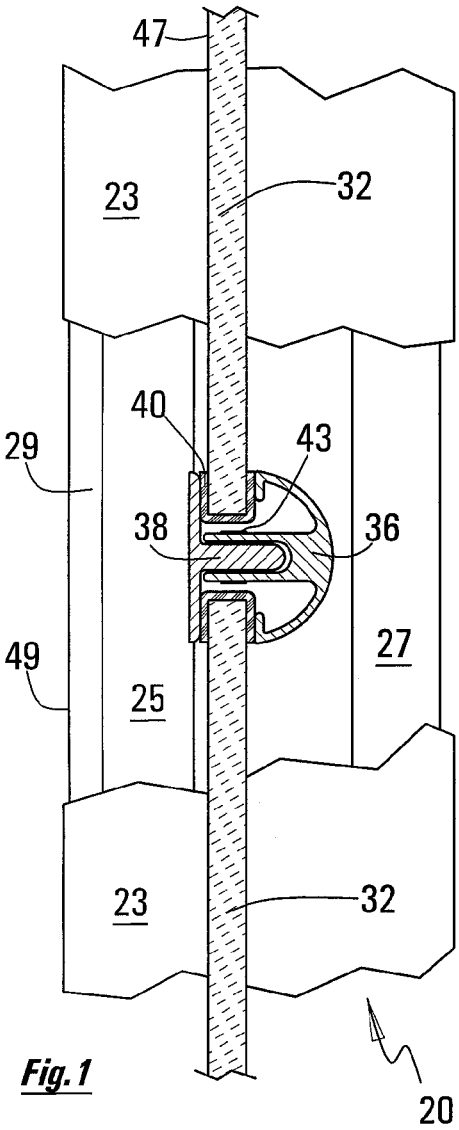
FIG. 1 is a plan view of a dasherboard assembly, topped by glass-shield panes.

FIG. 1 is a plan view looking down on the sill of a dasherboard assembly 20. The sill 23 is shown partially cut away. The dasherboard assembly includes a welded-up framework, which includes two rectangular-section hollow structural members, being an ice-side stringer 25 and a back-stringer 27. Attached to the ice-side stringer 25 is an ice-side pad 29.

Two glass-shield panes 32 are shown. These panes rest on top of the sill 23. The lateral edges of the panes 32 are retained in a suitably-shaped pillar 36. The pillar 36 in FIG. 1 is an extrusion in aluminum, and is designed to be used with a retainer-strip 38, which also is an aluminum extrusion, of a Tee-section.

Protective gaskets 40 can be provided, which are located between the edge of the pane 32 and the pillar 36 and retainer-strip 38.

To assemble the glass panes 32, the panes are placed upright between adjacent suitably-spaced pillars 36, and then the retainer-strips 38 are slipped onto the pillars.

The manner in which the retainer-strips 38 are attached to the pillars 36 is shown in FIG. 2. Pins 43 are provided in the pillar 36, and the retainer-strips 38 are provided with angled slots 45. With the pane 32 in place, a person manoeuvres the retainer-strips 38 so that the pins 43 engage into the slots 45. Gravity keeps the retainer-strips 38 in place. Removal is simply a matter of lifting the retainer-strips off the pins, and then removing the (remains of) the (broken) pane 32. The panes can be of tempered glass, or of acrylic plexiglas, etc. Other more expensive materials, such as laminated glass, can also be used. Mechanical aids for lifting the panes 32 are commonly provided in hockey rinks.

The set-up as shown in FIGS. 1,2 positions the panes 32 roughly (or exactly) in the middle of the sill 23. As such, the FIGS. 1,2 set-up is not included in the scope of patent protection sought herein.

FIGS. 3,4 show similar views to FIGS. 1,2 of another set-up, in which the glass-shield panes 32 have been moved forward towards the ice. In FIGS. 3,4, the ice-side surfaces 47 of the panes 32 lie flush with the ice-side surfaces 49 of the dasherboard pads 29.

The term "flush" should be construed as "substantially flush"; that is to say, flush to the extent that the horizontal projection on the ice-side of the boards is reduced to zero, or is reduced to such small dimensions as to present no danger, or a substantially reduced danger, compared with the corresponding danger presented by the traditional horizontal projecting sill, of injury to a player who is falling while crashing heavily into the boards. Thus, the term "flush" does not necessarily mean that the ice-sides 47 of the panes are geometrically co-planar with the ice-sides 49 of the dasherboard pads.

In FIGS. 3,4, an extra extrusion (in aluminum) has been added, termed a spacer-pillar 50. The extruded profile of the spacer-pillar 50 is shown individually in FIG. 3*a*. The profile is such that the spacer-pillar 50 can be assembled endwise (lengthwise) over a pillar which corresponds to the pillar 36, but is now termed a board-pillar 37. Thus, the provision of the spacer-pillar 50 means that the glass panes are moved forwards towards the ice.

In the FIGS. 3,4 structure, the board-pillars 37 are retained. As in FIGS. 1,2, in FIGS. 3,4 the boards have been constructed to accommodate the board-pillars 37. The board-pillar 37 passes down through a hole in the sill 23, and down between the ice-side stringer 25 and the back-stringer 27. The bottom end of the board-pillar 36 rests on a platform or ledge 52. The ledge 52 is attached to a pillar-support-stringer or middle-stringer 54 of the dasherboard framework. Suitable lateral retainers (not shown) keep the board-pillar 38 upright, and constrain it against tipping, and otherwise becoming misaligned.

The spacer-pillar 50 also serves to support the glass panes 32. That is to say, the spacer-pillar performs the dual functions of supporting the glass and spacing the glass forwards towards the ice. Thus, the spacer-pillar 50 is also a pane-pillar.

The FIGS. 3,4 design is such that the glass panes 32 can be moved flush with the dasher board pads 29 on a retro-fit basis. Thus, if rink owners wish to move the panes 32 so that they lie flush with the pads 49, they need only purchase a set of the spacer-pillars 50. The spacer-pillars 50 are assembled to the existing pillars 36—now shortened, thus becoming board-pillars 37—by sliding the pillar sections together lengthwise. The glass panes are then assembled and secured in place using the same retainer-strips 38. The spacer-pillars 50 are provided with pins 43, suitably located as to their heights, and the retainer-strip 38 slots onto the pins 43, in the same manner as in FIG. 2.

In FIG. 4, the spacer-pillar 50 rests on top of the existing sill 23 of the dasherboard framework, as do the glass-shield panes 32. The spacer-pillar 50 and the retainer-strip 38 extend over the full height of the panes, or over such fraction of the full height as the rink designers deem desirable.

Again, it should be understood that, in FIG. 4, the support-pillar 36 is still present, although now in the form of the shorter board-pillar 37. In FIG. 4, the board-pillar 37 need extend only so far up the height of the spacer-pillar 50 as to make sure the board-pillar 37 and the spacer-pillar 50 become functionally unitary, as far as the strength and positioning of the panes 32 is concerned. The designer preferably should see to it that the profiles of the two pillars correspond to each other in sufficient respects as to ensure that the members, when so assembled, are immovable in respect of e.g rotational motions about all axes, and indeed in respect of all modes of relative movement other than axial sliding.

In FIG. 5, the sill has been removed. Now, a pane socket-strip 56 (again, an aluminum extrusion) receives the bottom edge of the pane, and the socket-strip 56 is fastened to the ice-side stringer 25.

The socket-strip 56 provides robust support for the bottoms of the panes. This is particularly desirable around the radiused curves in the corners of the hockey rink. In the corners, the pads 29 are curved. (The panes, too, might/could be curved, but curved panes are much more expensive than flat panes, and curved panes can create reflections, and spoil the view of spectators.) The common arrangement, in a traditional rink, is that the pads 29 and the stringers 25,27 are curved, but the panes 32 are flat, whereby the adjacent flat panes, around the corners of the rink, lie at a small angle to each other. Thus, in the corners of the rink, the stringers 25 follow an arc, whereas the socket-strips 56 lie on respective chords. The straight socket-strips preferably should be wide enough as to engage the tops of the curved ice-side stringers 25, even at the widest separation of the chord and the arc.

In FIG. 5, there is no component like the sill 23, as a specific structure; and also there is (substantially) no part of the boards/glass combination that presents an upwards facing surface that has to be covered in order to minimize the likelihood of injury. A cover of some kind, if that is desired, can be placed over the stringers, simply by way of a shelf, on the spectator side of the glass panes.

In some rinks, the glass-shield panes are supported, not by vertical pillars of the kind shown at 36 in FIGS. 1-5, but by a different conventional support system. Here, the pane basically supports itself, as a structure, from its bottom edge. The bottom edge of the pane engages a complementary slot in a socket. Traditionally, in this system, the socket carrying the bottom edge of the pane nestles in the space between the ice-side stringer 25 and the back-stringer 27 of the framework of the dasher boards. In this system, there is basically no support provided in respect of the side edges of the panes, except that, near the tops of the panes, adjacent panes are anchored together by means of a top-clip.

FIG. 6 shows an alternative structure by which the glass-shield panes 32 can be mounted on the dasherboards, in such manner that the panes 60 lie flush with the ice-side pads 29. This alternative is applicable in the above-described case where the panes are mounted from their bottom edges, and there are no vertical pillars embedded in the dasherboard framework.

In FIG. 6, a socket-strip 63 is provided, which is bolted or otherwise firmly attached to the tops of the two stringers 25,27. The socket-strip 63 is formed with a trough 65, and the bottom edge of the pane 60 is received in the trough 65, to a depth of about fifteen cm. A gasket 67 fits between the trough and the sides of the glass pane 60.

The trough 65 can be deep enough that the bottom area of the trough 65 can lie below the bottom of the ice-side stringer 25. That being so, the ice-side pad 29 cannot be attached directly to the side of the stringer 25. A plate 69 is tacked to the socket-strip 63, for supporting and attaching the pad 29.

The socket-strip 63 is bent from sheet metal, typically being formed on a brake-press from sheet steel that is e.g two or three millimeters in thickness. The socket-strips 63 preferably are around 1.2 meters long, corresponding to the width of the glass panes.

FIG. 7 shows another alternative arrangement, in which the glass is again (as in FIG. 6) supported in a trough at its bottom edge, rather than by posts or uprights like the pillars in FIGS. 1-5.

In FIG. 7, the trough 70 is formed as an extrusion in aluminum. The extrusion is attached to the upper surface of the ice-side stringer 25. The glass pane 47 fits into the trough 70. Again, a gasket fits between the walls of the trough and the sides of the glass pane. In FIG. 7, the ice-side pad 29 overlies the trough structure, and the gasket 67 may be arranged to enwrap the upwards-facing edge of the pad 29. A cap 72, or shelf, is fixed in position on the non-ice side of the glass pane.

In FIG. 7, the ice-side stringer 25 has been placed at a lower height than the back-stringer 27. The reason for this is that, even though the trough 70 has been placed on top of the ice-side stringer 25, the presence of the trough 70 does not reduce the field of view of the spectators. The FIG. 7 arrangement would generally not be suitable in the case of a retro-fit to an existing rink installation. By contrast, the FIG. 6 arrangement does lend itself to retro-fit applications.

FIG. 8 shows another alternative arrangement, in which the glass is again (as in FIG. 6) supported in a trough at its bottom edge, rather than by posts or uprights like the pillars in FIGS. 1-5. Here, the trough unit 80 is formed from two sections of folded sheet metal (e.g steel). The two sections are welded together where they touch. The outer section 82 is folded to wrap around the ice-side stringer 25, while the inner section 83 is folded so as to overlie the back-stringer 27. The sections are attached to the stringers in any suitable manner. The FIG. 8 manner of forming and attaching the trough means that the trough is integrated into the two stringers very securely.

As shown in FIG. 8, structure (here, in the form of board-pillars 85) can be provided which extends down from the two top stringers 25,27 to the middle-stringer 54, or to some other suitable location of the board-framework. The stresses on the panes 32 when players crash into the glass can be considerable, and it can be important to feed those stresses into the dasherboard as a whole unit, rather than into just the top stringers. The pillars 85 are spaced appropriately as required for transmitting the stresses. The outer-section 83 may be ribbed, e.g as shown, for the same reasons.

FIG. 9 shows another alternative arrangement in which the glass is supported on pillars. Here, again, the board-pillar 37 is structured and supported, in and by the dasherboard, in the conventional manner. But now, as in FIG. 4, a spacer-pillar 90 fits over the board-pillar 36. The spacer-pillar 90 may be an extrusion, e.g in aluminum, being so shaped that it cannot move in any direction or mode, relative to the board-pillar 36, other than axial sliding. The spacer-pillar 90 slides down the board-pillar 36, coming to rest on top of the sill 23, again as in FIG. 4. (A through-hole is cut in the material of the sill 23 for the board-pillar 36 to pass through.)

The spacer-pillar 90 is about 30 cm high. In FIG. 9, the spacer-pillar 90 is shaped to receive a separate pane-pillar 92. The pane-pillar extends (almost) the full height of the panes 32. The pane-pillar 92 may be an extrusion, e.g in aluminum, being so shaped as to receive two of the panes 32 (preferably with gaskets 40) and the retainer-strip 38. The profiles of the board-pillar 37, the spacer-pillar 90, the pane-pillar 92, and the retainer-strip 38, and the manner in which they interact, are shown in FIG. 10.

As shown in FIG. 9, the spacer-pillar 90, the pane-pillar 92, and the panes 32, all rest against the top surface of the sill 23. In FIG. 11, a groove is provided in the sill 110, and the pane 32 rests in the groove. The bottom edge of the pane 32 can be vulnerable to damage, and the groove helps in that regard. The groove being present, the portion of the sill 110 that lies on the ice-side of the groove inevitably protrudes, towards the ice, beyond the ice-side surface 47 of the pane 32. In keeping with the underlying basis for the present technology, such protrusions should be as small as possible, commensurate with the need for the ice-side wall of the groove to be mechanically strong enough.

It is suggested that the designers should always aim to keep protrusions, as measured from the ice-side surface 47 of the pane 32, in the direction towards the ice, below about 2.5 centimeters. It is suggested also that if a protrusion were to exceed about 3.5 cm, that would be an indication that the designers were not seeking to eliminate the protrusions, in accordance with the technology as described herein.

The protrusions, in the above paragraph, are protrusions that face upwards. A surface, or a portion of a surface, is defined as facing upwards if it lies at an angle of about forty-five degrees, or less, to the horizontal. Thus, a surface that sloped downwards at an angle of more than 45° to the horizontal would not be a "protrusion" as that term is used herein—on the basis that the ability of a surface sloping at such an angle to cause injury to a falling player's face is minimal.

Other variants are possible, for new installations in which the stringers can be redesigned. In FIG. 12, no spacers are required, in order for the pane to be moved towards the ice. Rather, in FIG. 12, the ice-side stringer now takes the form of a strip 120 of sheet metal, typically being a strip of 13 mm-thick aluminum. The strip 120 is attached to the back-stringer 123 by means of connecting struts 125, spaced at suitable intervals lengthwise along the framework of the dasherboard. The horizontal width of the back-stringer 123 is increased, corresponding to the reduced horizontal width of the ice-side stringer 120.

In FIG. 12, the panes 32 are connected directly to the pillars 36, which function as they did in FIGS. 1,2, except that the pillars 36, and the panes 32, are now moved closer to the ice. The panes 32 rest on the sill 23. The pillars 36 rest on the middle-stringer 54.

FIG. 13 shows a variant in which the ice-side stringer now takes the form of a trough 130, being the trough in which the bottom edge and bottom margin of the pane are to be held. Again, the back-stringer 132 has been correspondingly extended, width-wise. The ice-side-pad 29 is trimmed at its top edge by a fold of a shaped liner 134, which lines the inside of the trough 130, and which can be extended over the back-stringer 132 as desired. A strut 136 is rigid with the bottom of the trough 130, and is attached to the middle-stringer 54. Thus, the stresses and strains applied when a player crashes into the glass are distributed throughout the dasher-board framework.

As can be seen, the protrusions on the ice-side of the panes are greater in the trough-mounted pane system of FIG. 13 than in the pillar-mounted system of FIG. 12, but still the protrusions are considerably reduced compared with the protrusions to be found in conventional trough-mounted pane installations. Generally, it is readily possible to more or less eliminate protruding upwards-facing surfaces when the panes are pillar-mounted, as shown in FIGS. 3,4,5,9,11,12. But the trough-mounted systems generally leave a protruding upwards-facing surface, as in FIGS. 7,13. FIGS. 6,8 do more or less remove all protrusion, but at the expense of leaving the ice-side of the trough relatively unsupported, which is less preferred.

Dasherboards in the corners of ice-rinks are rounded, typically at a radius of 8.5 meters. As mentioned, the dasherboards themselves are rounded, but the glass panes are often not rounded. FIG. 14 shows a portion of a curved board unit, in which the panes are curved, to follow the curvature of the dasherboards, while FIG. 15 shows a portion of a similar curved board unit, in which the panes are straight, or flat, and are laid at a small angle relative to each other in order to follow the curvature of the dasherboards.

It will be noted that, in FIG. 15, an upwards-facing surface, or land, 150 is exposed—being the land of width L as indicated in the close-up view of FIG. 15*a*. The components should be arranged such that the dimension L at no point exceeds 3.5 cm, and preferably should be less. On the other hand, the pane should not be allowed to overhang the sill, because the exposed edge can be vulnerable to damage. In the corners of the rink, the glass is typically 15 mm thick (being typically 12 mm thick in the straight areas).

NUMERALS USED IN THE DRAWINGS MAY BE SUMMARIZED AS

20 dasherboard assembly
23 sill
25 ice-side stringer
27 back-stringer
29 ice-side pad
32 glass-shield panes
36 pillar
37 board-pillar
38 retainer-strip
40 gaskets
43 pins
45 angled slots
47 ice-side surface of pane 32
49 ice-side surface of pad 29
50 spacer-pillar
52 ledge
54 middle-stringer
56 socket-strip for pane
60 pane (FIG. 6)
63 socket-strip
65 trough
67 bottom area of trough
69 plate
70 trough (FIG. 7)
72 cap or shelf
80 trough unit (FIG. 8)
82 outer section
83 inner section
85 board-pillar
90 spacer-pillar
92 pane-pillar
110 sill with groove
120 ice-side-stringer=strip of sheet metal
123 back-stringer
125 connecting struts—120 to 123
150 upwards-facing land

The invention claimed is:

1. Dasherboard assembly, wherein:
the assembly includes board-sections, which surround and enclose a playing-surface;
the board-sections are at least thirteen cm thick;
the assembly includes panes;
the panes are fixed on top of the board-sections;
the panes have respective inwards-facing faces;
the improvement wherein:
the assembly is characterized by the absence, as a structure, of any protrusion inwards from the inwards-facing faces of the panes;
being a protrusion which, if present, would present a significant upward-facing portion thereof to the face or head of a player who is falling down while crashing into the assembly; and
portions of the protrusions are defined as upwards-facing insofar as the portions lie at an angle of 45° or less to the horizontal.

2. As in claim 1, wherein the upward-facing portion of the protrusion is defined as significant if the portion protrudes, in the inwards direction, more than 3.5 centimeters, measured from the inwards-facing face of the pane.

3. As in claim 1, wherein the upward-facing portion of the protrusion is defined as significant if the portion protrudes, in the inwards direction, more than 2.5 centimeters, measured from the inwards-facing face of the pane.

4. As in claim 1, wherein:
the board-sections include respective frameworks, having ice-side pads on the insides thereof;
the board-sections are so configured as to be bolted or otherwise fastened to the floor, and to each other;
the frameworks of the board-sections include respective top stringers, located at or near the tops of the frames;
the frameworks include respective pillar-support-stringers, located lower down the framework;
the assembly includes board-pillars, spacer-pillars, and pane-pillars;
the board-pillars extend down from the top stringers to the pillar-support-stringers;
the panes engage the pane-pillars and are physically supported thereby;
the spacer-pillars engage the board-pillars, and the pane-pillars engage the spacer-pillars;
the pane-pillars are supported from the board-pillars by the engagement of both with the spacer-pillars;
the structural arrangement of the pillars, and of the engagements between them, are such that the panes are physically supported by and from the frameworks; and
the dimensional configuration of the pillars is such that the pane-pillars are spaced laterally inwards relative to the board-pillars.

5. As in claim 4, wherein:
the board-sections include respective caps or sills;
the sills reside on top of the frameworks, and overlie the ice-side pads thereof;
the panes reside on top of the board-sections in that the panes rest on top of the sills;
the sills have respective upwards-facing faces thereof;
the protruding upward-facing portions comprise protruding upward-facing faces of the sills;
the board-pillars extend from above the height of the sills, down through the sills, down to the pillar-support-stringers.

6. As in claim 5, wherein the spacer-pillars and the pane-pillars rest against upwards-facing surfaces of the sills.

7. As in claim 4, wherein:

the pane-pillars are incorporated into the spacer-pillars, to form unitary-pillars; and the unitary-pillars, in which the spacer-pillars and the pane-pillars are combined, are separate from the board-pillars.

8. As in claim 7, wherein:

the board-pillars are of a constant cross-section along their lengths;

the unitary-pillars that combine the spacer-pillars and the pane-pillars are of a constant cross-section along their lengths;

the cross-sections of the unitary-pillars are so shaped as to interlock, on a male/female basis, with the cross-sections of the board-pillars.

9. As in claim 4, wherein:

the board-pillars are of a constant cross-section along their lengths;

the spacer-pillars are of a constant cross-section along their lengths;

the pane-pillars are of a constant cross-section along their lengths;

the cross-sections of the pane-pillars are so shaped as to interlock, on a male/female basis, with the cross-sections of the spacer-pillars;

the cross-sections of the board-pillars are so shaped as to interlock, on a male/female basis, with the cross-sections of the spacer-pillars.

10. As in claim 4, wherein:

the top-stringers include respective spaced-apart top-inside-stringers and top-back-stringers;

the board-pillars, in extending down from the top-stringers to the pillar-support-stringers, pass between the top-inside-stringers and the top-back-stringers.

11. As in claim 1, wherein:

the board-sections include respective frameworks, having ice-side pads on the insides thereof;

the board-sections are so configured as to be bolted or otherwise fastened to the floor, and to each other;

the frameworks are provided with respective troughs;

the troughs are physically integrated into the frameworks; and the troughs support the panes in that bottom margins of the panes are received within the troughs.

12. As in claim 11, wherein:

the frameworks of the board-sections include respective top stringers, located at or near the top of the frame;

the frameworks include respective pillar-support-stringers, located lower down the framework;

the troughs are physically integrated with board-pillars;

the board-pillars extend downwards from the trough and are attached to the pillar-support-stringers of the frameworks;

the board-pillars are configured, when a player crashes into the dasherboards, to transmit some of the consequent heavy stress and strain to the pillar-support-stringers and thence into the framework generally.

13. As in claim 11, wherein the trough is so integrated into the top stringer that impacts received into the trough from the glass are transmitted into the top stringer.

14. As in claim 1, wherein the dasherboard assembly is suitable for use in an ice-rink, for the sport of ice-hockey.

15. Procedure for modifying a dasherboard system of an ice-rink, including:

where the dasherboard system initially is one in which panes are supported with respect to a framework of the dasherboard by means of single-pillars; and where an inside surface of the panes is spaced a distance D1 outwards of a point P on the dasherboard;

where frameworks of the dasherboards include respective top stringers, located at or near the tops of the frames;

where the frameworks include respective pillar-support-stringers, located lower down the framework;

where the single-pillars extend down from the top stringers to the pillar-support-stringers;

removing the panes;

providing spacer-pillars, pane-pillars, and board-pillars;

where the spacer-pillars are (a) combined with the pane-pillars to form unitary pillars; or are (b) separate from, and assembled to, the pane-pillars;

assembling the spacer-pillars to the board-pillars;

assembling panes to the pane-pillars;

where the spacer-pillars and board-pillars are so shaped and configured that, when the spacer-pillars are assembled to the board-pillars, the said inside surface of the panes is now spaced a distance D2 outwards from the said point P on the dasherboard;

the pane-pillars now lie substantially closer to the ice, in that the distance D2 is significantly smaller than the distance D1.

* * * * *